US005113554A

United States Patent [19]

Gallo et al.

[11] Patent Number: 5,113,554

[45] Date of Patent: May 19, 1992

[54] CLOTHING HANGER CLIP

[76] Inventors: Christine A. Gallo, 32 Esperanza, Ste. H., Sierrra Madre, 91204; Bianca M. Giglio, 900 W. Sierra Madre Ave. #66, Azusa, Calif.

[21] Appl. No.: 691,790

[22] Filed: Apr. 26, 1991

[51] Int. Cl.[5] ..... A44B 21/00

[52] U.S. Cl. ..... 24/545; 24/547; 24/562; 223/88; 223/96

[58] Field of Search ..... 24/545, 546, 547, 555, 24/556, 562, 67.9; 223/85, 93, 96, 88

[56] References Cited

U.S. PATENT DOCUMENTS

| | | | |
|---|---|---|---|
| 2,938,252 | 5/1960 | Scheemaeher | 24/547 X |
| 3,950,823 | 4/1976 | Schieter | 24/562 X |
| 5,010,629 | 4/1991 | Hirzel | 24/547 X |

FOREIGN PATENT DOCUMENTS

| | | | |
|---|---|---|---|
| 32807 | 3/1973 | Australia | 24/562 |
| 568407 | 10/1960 | Belgium | 24/547 |
| 668973 | 9/1965 | Belgium | 24/545 |
| 584761 | 1/1947 | United Kingdom | 24/67.9 |

*Primary Examiner*—Laurie K. Cranmer
*Attorney, Agent, or Firm*—Plante, Strauss & Vanderburgh

[57] ABSTRACT

There is disclosed a clip which is molded of plastic and which has a design particularly adapted to retain fabrics on the crossbar of a conventional clothes hanger. The clip has a C-shaped body having opposite, coincident legs dependent from a central bight section, an integrally formed prong dependent from the bight section and an upright base leg projecting out of the plane of the clip body with a first reverse bend adjacent the base leg and a return prong section which is inclined towards the plane of the clip, and a second reverse bend in the prong to provide an upwardly curled tip which also projects out of the plane of the clip. The height of the base of the prong and the first reverse bend are sized to provide sufficient clearance from the body of the clip to permit snap-over retention of the clip on the cross bar of a hanger. Preferably, the body legs and the prong have textured or roughened opposing surfaces to enhance their gripping properties.

20 Claims, 2 Drawing Sheets

CLOTHING HANGER CLIP

BACKGROUND OF THE INVENTION

1. Field of Invention

This invention relates to a clothing clip and, in particular, to a clip for securing clothing to a clothes hanger without damage to the fabric.

2. Brief Statement of the Prior Art

Garments have been hung over lines, wires and the like, with clip-type fasteners, the most traditional being a wooden clothespin. Increasing usage of clothes dryers and the convenience of cleaning establishments, as well as the cost and bulk of the wooden clothespin has lead to its demise. While plastic clips of various shapes and materials have been suggested for use to retain clothes, heretofore, there has been no clip which is specifically designed to retain clothes on a conventional hanger.

Since there is no effective and inexpensive clip for securing clothes to a conventional hanger, cleaning establishments and dry cleaners often pin the fabric of smoothly textured garments such as silk, rayon, etc., to the hanger. This practice can damage the garment.

Accordingly, there is a need for an inexpensive and effective clip to retain garments on the bar of the hanger. Such a clip could also offer the additional advantage of carrying indicia such as an advertising message and the like promoting the cleaning establishment.

BRIEF STATEMENT OF THE INVENTION

The invention comprises a clip which is molded of plastic and which has a design particularly adapted to retain fabrics on the crossbar of a conventional clothes hanger. The clip has a C-shaped body having opposite, coincident legs dependent from a central bight section, an integrally formed prong dependent from the bight section and having an upright base leg projecting out of the plane of the clip body with a first reverse bend adjacent the base leg and a return prong section which is inclined towards the plane of the clip, and a second reverse bend in the prong to provide an upwardly curled tip which also projects out of the plane of the clip. The height of the base of the prong and the first reverse bend are sized to provide sufficient clearance from the body of the clip to permit snap-over retention of the clip on the cross bar of a hanger. Preferably, the body legs and the prong have textured or roughened opposing surfaces to enhance their gripping properties.

OBJECTIVES OF THE INVENTION

It is an object of this invention to provide an improved clothing clip which will releasably secure garments to the bar of a hanger without damaging the fabric of the clothing.

It is a further object of this invention to provide the aforementioned clip with a simple design which is inexpensive to produce by mass production techniques.

It is also an object of this invention to provide the aforementioned clip with a design which is capable of manufacture in an injection mold having a single parting plane.

It is an additional object of the invention to provide a clothing clip that will securely retain garments of delicate fabrics without damage to the fabric.

Other and related objects will be apparent from the following description of the invention.

BRIEF DESCRIPTION OF THE DRAWINGS

The invention will be described with reference to the figures of which.

DESCRIPTION OF PREFERRED EMBODIMENT

Figure 1:
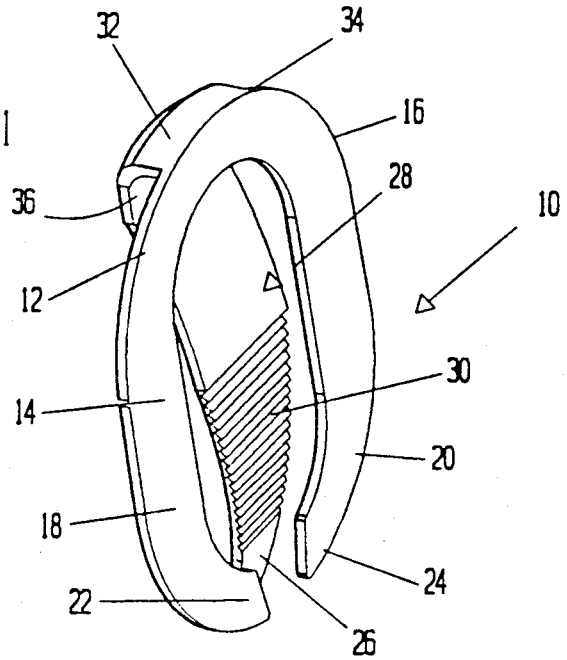
FIG. 1 is a perspective view of the front of the clip of the invention.
Figure 2:
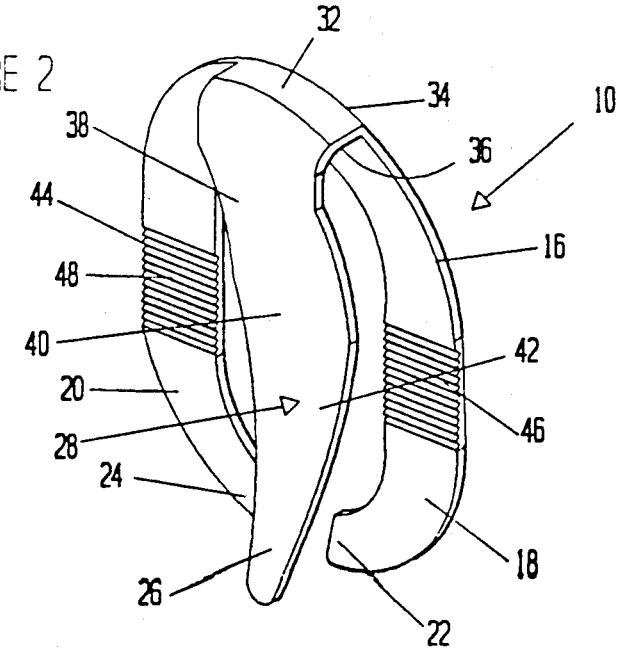
FIG. 2 is a perspective view of the rear of the clip of the invention.

As shown in FIGS. 1 and 2, the clip of the invention is shown in FIG. 1 as having a generally C-shaped body 10 with two substantially parallel and coincident legs 12 and 14 which project from a central bight section 16. The ends 18 and 20 of the legs 12 and 14 are preferably curved inwardly to provide inwardly directed tips 22 and 24 which are separated by a distance that is sufficient to permit passage of the tip 26 of the prong 28 during flexing of the latter.

The prong 28 has a base leg 32 that projects out of the plane of the body 10, and that is dependent from the upper edge 34 of the bight section 16. As described in greater detail hereinafter, the base leg 32 is inclined at an acute angle, rather than at 90 to the plane of the body 10 for ease in manufacturing. The base leg 32 projects upwardly a significant distance and is connected to the remainder of the prong 28 by a reverse bend 36 to provide an intermediate prong section 38 that is inclined towards the body 10.

The prong 28 has a second reverse bend 40 of opposite direction between its intermediate section 38 and end 42 to provide an upwardly curled or upwardly directed prong tip 26. In the preferred embodiment, the end 42 of the prong 28 is tapered with progressively decreasing width along its length, terminating in a tip 26 of substantially reduced width.

The side of the clip of the invention opposite to that shown in FIG. 1 is illustrated in perspective view by FIG. 2. As apparent from FIGS. 1 and 2, roughened surfaces 46 and 48 in the form of a plurality of parallel V-grooves 44 are provided on the opposing surfaces of the legs 12 and 14 and a similarly roughened surface 30 is provided on the end section 42 of prong 28. Preferably, the roughened surface extends along the end portion 42 of the prong.

The clip is limited in size; it can have a width from $\frac{3}{4}$ to about 1.5 inches, preferably from $\frac{7}{8}$ to about 1.25 inches. Its height can be from about 1 to 3 inches, preferably from 1.25 to about 1.5 inches. The thickness of the body and prong can be from about 1/32 to about 3/16 inch, preferably from about 1/16 to about 5/32 inch.

Figure 3:
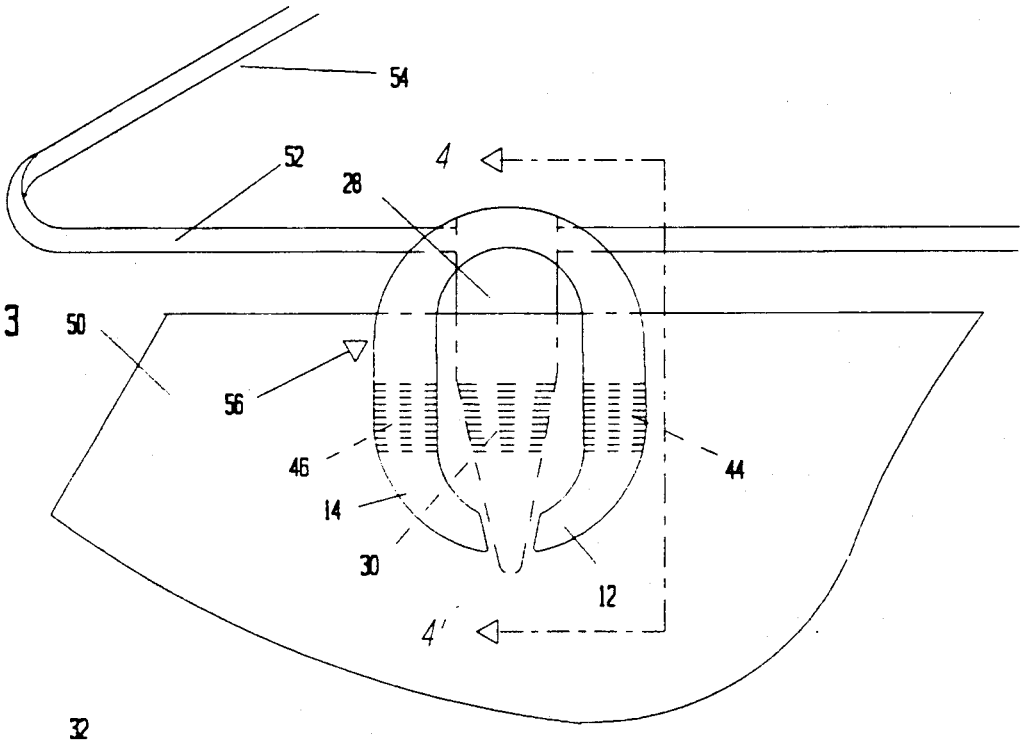
FIG. 3 illustrates the clip of the invention in its intended application to the bar of a conventional hanger.

Referring now to FIG. 3, the clip 56 of the invention is shown in its intended application for retaining a garment 50 on the bar 52 of a hanger 54. The garment is shown in phantom lines to permit a view of the clip and hanger. In this application, the garment 50 can be draped over the hanger in a conventional manner or can simply be secured entirely by the clip of the invention. In the illustrated application, the garment 50 is secured entirely by the clip 56, and the prong 28 of the clip 56 is snapped over the bar 52 of the hanger 54 with the hanger bar 52 being entirely received within the gap 58 (see FIG. 4) provided between the base leg 32 and first reverse bend 36 of the prong 28. Preferably, this gap 58 is sized with sufficient dimension to fit the bars of most conventional wire hangers. The gap is sized so that the bar of a wire hanger is received with a slight frictional fit, thereby insuring that the clip does not easily slide along the bar, but instead can be used to maintain a tautness in the fabric of the garment 50 secured to the hanger. For this purpose, the gap can be from 1/16 to about ¼ inch, preferably from ⅛ to 3/16 inch. The garment 50 is clasped between the prong 28 and opposed surfaces of the body legs 12 and 14 of the clip 56. The garment 50 can be readily inserted into the clip 56, as the outwardly curled or inclined tip 26 of the prong 28 provides an entrance which permits one to lift the prong 28 with one's finger or which permits deflection of the prong 28 simply by pushing the upper edge of the garment 50 into place.

Figure 4:
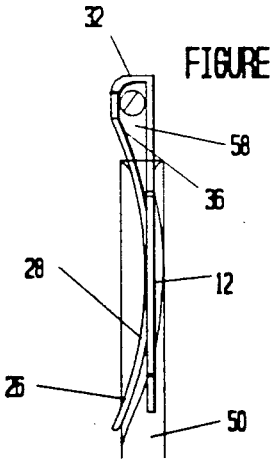
FIG. 4 is a view along line 4—4' of FIG. 3.

Referring to FIG. 4, the cross bar 52 of the hanger 54 can be seen to be received in a loose fit within the gap 58 formed between the body 10 and the prong 28, as determined by the height of the base leg 32 of the prong 28 and the radius of the reverse bend 36.

As previously mentioned, the base leg 32 of the prong 28 is preferably inclined at an acute angle to the plane of the body. This permits molding of the clips in an injection mold having a single parting plane along the plane of the clip body 10. The prong 28 is formed in a cavity in one half of the mold. The opposite surface of the prong 28 is formed by a protrusion carried on the other half of the mold which is shaped to the undersurface of the prong. In this fashion the clips can be mass-produced using conventional injection molding techniques without the use of runners or the necessity to complicate the mold design by requiring that it separate along a second parting line.

Figure 5:
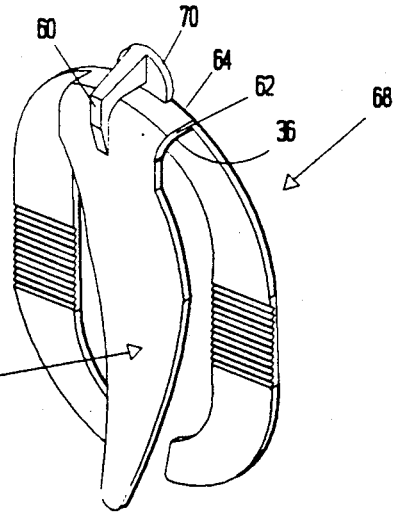
FIG. 5 illustrates an alternative design.

The clip of the invention can be provided with alternative configurations. If desired, the strength and longevity of the clips can be enhanced by providing a strengthening rib in the base section as shown in FIG. 5 where a centrally located rib 60 extends coextensively with the base section 62. If necessary, the bight section 64 of the body 66 of the clip 68 can be extended with a boss such as the semicircular boss 70 to provide an extended base for the strengthening rib 60 of the clip.

Preferably, the clip is formed of a polymer having a high fatigue resistance such as polyimides, polyesters, e.g., Nylon, acetal polymers, etc.

The invention provides the advantages of securely retaining delicate garments to the bars of conventional hangers without damaging the garments. Additionally, advertising such as company logos or public service statements can be imprinted on the prong which has a sufficiently wide upper portion to carry such messages. The messages can be applied by printing directly on the clip, application of adhesive decals, etc.

Because of the adaptability of the clip design to mass-manufacture using injection molding with uncomplicated molds, the clip can manufactured at very low cost which should contribute to its popularity and usefulness. As the clip has relatively low manufacturing cost, it is a readily disposable item and, accordingly, even plastics of limited fatigue life can be readily used for the manufacture of the clip.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A clip, garment hanger and sheet material which comprise:

a. a U-shaped clip body having opposite coincident legs dependent from a bight section;

b. an integral clip prong centrally dependent from said bight section and a base leg projecting out of said body plane;

c. a first reverse bend in said prong adjacent said base leg to provide a return section inclined towards and intersecting said body plane of said U-shaped body; and d. a second reverse bend in said prong to provide a prong end that also projects out of said body plane;

e. said garment hanger having a straight horizontal bar slidably received between said first reverse bend and said bight section of said U-shaped clip body; and f. said sheet material received and secured between said prong and said legs and supported by said clip beneath said bar and out of contact with said hanger.

2. The clip, garment hanger and sheet material of claim 1 wherein said U-shaped body is a flat planar body.

3. The clip, garment hanger and sheet material of claim 2 wherein said second reverse bend has a substantially greater radius of curvature than said first reverse bend.

4. The clip, garment hanger and sheet material of claim 1 herein said first and second reverse bends are curvilinear.

5. The clip, garment hanger and sheet material of claim 1 wherein said first reverse bend provides a closed loop between said body and prong which has sufficient dimensions to permit said loop to be slipped onto the bar of a garment hanger in a sliding retention thereon.

6. The clip, garment hanger and sheet material of claim 1 including surface texture means on opposed surfaces of said prong and body legs to grip said sheet material.

7. The clip, garment hanger and sheet material of claim 5 wherein said surface texture means is a plurality of closely spaced grooves in the surfaces of said prong and body legs.

8. The clip, garment hanger and sheet material of claim 7 wherein said grooves are parallel.

9. The clip, garment hanger and sheet material of claim 6 wherein said sheet material is a garment.

10. The clip, garment hanger and sheet material of claim 1 wherein the ends of said legs of said body have inwardly directed tips.

11. The clip, garment hanger and sheet material of claim 1 wherein said clip is molded of a fatigue-resistant polymer.

12. The clip, garment hanger and sheet material of claim 1 wherein said clip is molded of a polymer selected from the class of polyamide, polyester and acetal polymers and copolymers.

13. The clip, garment hanger and sheet material of claim 1 wherein said prong has a smooth surface to provide a surface for reception of indicia.

14. The clip, garment hanger and sheet material of claim 13 wherein said sheet material is a garment.

15. The clip, garment hanger and sheet material of claim 1 wherein said coincident legs have inwardly directed ends.

16. The clip, garment hanger and sheet material of claim 15 wherein said prong has a distally tapered section of uniform thickness.

17. The clip, garment hanger and sheet material of claim 16 wherein the tapered section of said prong is received between the inwardly directed ends of said legs of said body.

18. The clip, garment hanger and sheet material of claim 17 wherein said sheet material is a garment.

19. The clip, garment hanger and sheet material of claim 1 including a flat boss extending from an upper edge of said bight section, and a reinforcement rib centrally located and extending coextensively with said base leg and along said return section of said prong.

20. The clip, garment hanger and sheet material of claim 1 wherein said sheet material is a garment.

* * * * *